United States Patent [19]

Kashiwagi

[11] Patent Number: 4,840,506

[45] Date of Patent: Jun. 20, 1989

[54] PRINTER

[75] Inventor: Kazuhiko Kashiwagi, Tokyo, Japan

[73] Assignee: Kabushiki Kaisha Toshiba, Kawasaki, Japan

[21] Appl. No.: 99,291

[22] Filed: Sep. 21, 1987

[30] Foreign Application Priority Data

Sep. 22, 1986 [JP] Japan ..... 61-144101[U]

[51] Int. Cl.[4] ..... B41J 11/70; B41J 29/00

[52] U.S. Cl. ..... 400/621; 400/690.4; 101/226; 83/249

[58] Field of Search ..... 400/621, 719, 690.4; 101/224, 226; 83/249

[56] References Cited

U.S. PATENT DOCUMENTS 4,483,635 11/1984 Nisier et al. ..... 400/621 X
4,568,211 2/1986 Fox et al. ..... 400/690.4 X

FOREIGN PATENT DOCUMENTS 61634 10/1982 European Pat. Off. ..... 400/621
142680 11/1980 Japan ..... 400/621
113483 9/1981 Japan ..... 400/621
155084 9/1984 Japan ..... 400/621
52378 3/1985 Japan ..... 400/621
176787 9/1985 Japan ..... 400/621

*Primary Examiner*—Charles Pearson
*Assistant Examiner*—James R. McDaniel
*Attorney, Agent, or Firm*—Finnegan, Henderson, Farabow, Garrett and Dunner

[57] ABSTRACT

A printer includes a main body having an upper opening. A platen is arranged in the main body such that it opposes the opening. A cover is mounted on the main body such that it is pivotable between a closing position, for covering the opening except for a portion above the platen, and an opening position, for exposing the opening. A cutter having a blade is supported on the inner surface of the cover such that it opposes the main body. The cutter is pivotable between a stand-by position, where the blade is located above the platen, a cutting position, where the blade abuts against the peripheral surface of the platen, and a housing position, where the blade is located at a side opposite to the platen, about the pivotal center of the cutter. The cutter is selectively urged by springs toward the stand-by position or the housing position.

12 Claims, 5 Drawing Sheets

PRINTER

BACKGROUND OF THE INVENTION

The present invention relates to a printer and, more particularly, to a printer having a cutting mechanism for cutting off a printed portion of continuous paper from a nonprinted portion.

Generally, a printer for printing on continuous paper includes a cutting mechanism for cutting off a printed portion of continuous paper from a nonprinted portion. This cutting mechanism is arranged so as to cut continuous paper at a position separated by about one inch from the printed portion and, for this reason, is known as a one-inch cutting mechanism.

A printer of this type includes a case in which are arranged a platen, a printing head opposing the platen, and a push-type tractor for feeding continuous paper between the platen and the printing head. A detachable front cover covers the upper opening portion of the case, and the cutting mechanism is mounted on the inner surface of the cover. The cutting mechanism has a cutter pivotally mounted on the inner surface of the front cover, and the distal end of the cutter can abut against the outer surface of the platen and projects from the end of the cover. The cutter is biased by a spring toward the inner surface of the cover, i.e., in a direction away from the platen. In addition, the case has a detachable acoustic cover which is mounted on an upper portion thereof, for reducing noise during printing, and which covers the distal end of the cutter projecting from the front cover. When the paper is to be cut, the acoustic cover is removed from the case, and the cutter is pivoted, against a biasing force of the spring, to a position where the distal end thereof abuts against the surface of the platen while sandwiching the continuous paper therebetween. With the cutter arranged thus, continuous paper is pulled up and cut by the cutter.

When cut sheets are to be printed on, instead of continuous paper, a cut sheet feeder is mounted on the case so as to be located above the platen. However, the acoustic cover and the distal end of the cutter projecting from the front cover are located above the platen, thereby preventing mounting of the cut sheet feeder on the case. For this reason, in order to mount the sheet feeder on the case, not only the acoustic cover but also the front cover together with the cutting mechanism must be detached from the case. As a result, an operation becomes troublesome, and a space is required for the detached front cover.

SUMMARY OF THE INVENTION

The present invention has been conceived in consideration of the above situation, and has as its object to provide a printer in which a paper sheet feeder can be mounted on a case of the printer without detaching a cutting mechanism from the case.

In order to achieve the object, according to the present invention, there is provided a printer which comprises: a main body having an upper opening; a platen positioned within the main body such that it opposes the upper opening; a printing head positioned within the main body to be movable along the platen; sheet-feeding means, located within the main body, for supplying continuous paper around the platen; a cover located on the main body to be movable between a closing position, for covering the opening except for a portion above the platen, and an opening position, for exposing the opening; and a cutting mechanism for cutting continuous paper at a predetermined position, the cutting mechanism including: a first holding portion arranged on the cover; a cutter supported by the cover to oppose the main body, the cutter having a proximal end portion pivotally supported by the cover, and located between the first holding portion and the platen, and a blade extending from the proximal end portion the cutter being pivotally arranged between a stand-by position, where the blade is located above the platen, a cutting position, where the blade abuts against the circumferential surface of the platen, and a housing position, where the blade is located at a side opposite to the platen, about the proximal end portion and adjacent to the cover, and said cutter having a second holding portion, the second holding portion being located at a side of the cover with respect to a line extending through the first holding portion and the pivotal center of the proximal end portion of the cutter, when the cutter is located at the stand-by position; and a biasing member located between the first and second holding portions, for biasing the cutter toward the stand-by position when the second holding portion is located at a side of the cover with respect to the line, and for biasing the cutter toward the housing position when the second holding portion is located at a side of the main body with respect to the line.

BRIEF DESCRIPTION OF THE DRAWINGS

FIGS. 1 to 7 show a printer according to an embodiment of the present invention, in which:

FIG. 1 is a partially cutaway side view of the printer, showing a state wherein the cutter is located at the stand-by position;

FIG. 2 is an enlarged side view of the cutting mechanism shown in FIG. 1;

FIG. 3 is an exploded perspective view of the cutting mechanism of FIG. 1;

FIG. 4 is a partially cutaway side view corresponding to FIG. 1, showing a state wherein the cutter is located at the cutting position;

FIG. 5 is an enlarged side view of the cutting mechanism shown in FIG. 4;

FIG. 6 is a partially cutaway side view of the printer, showing a state wherein the cutter is located at the housing position, and a cut sheet feeder is mounted on the case of the printer; and FIG. 7 is an enlarged side view of the cutting mechanism shown in FIG. 6.

DETAILED DESCRIPTION OF THE PREFERRED EMBODIMENT

An embodiment of the present invention will now be described below, with reference to the accompanying drawings.

Figure 1:
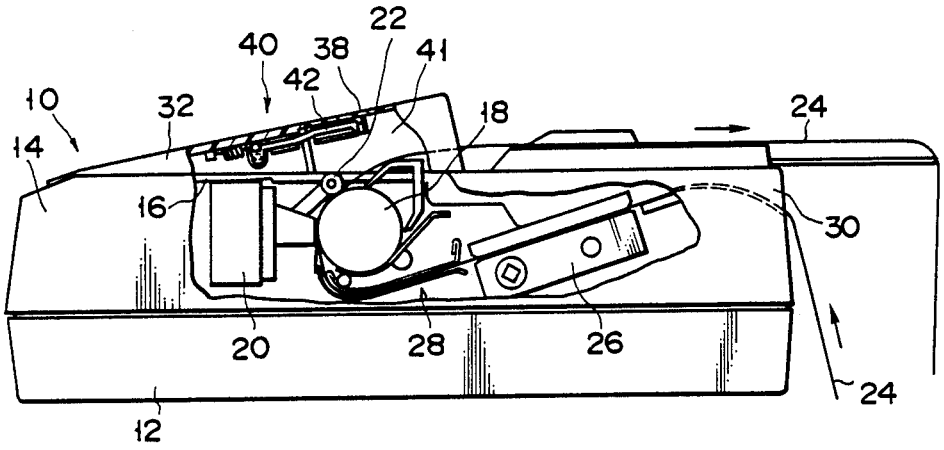

As is shown in FIG. 1, a printer according to the present invention includes main body 10 having lower case 12 and upper case 14, and opening 16 is formed in an upper surface of case 14. Opening 16 extends from a central portion to a front end portion of the upper surface of case 14. Platen 18, printing head 20 which is positioned such that it opposes the platen and is movable therealong, and bail roller 22 for urging paper against the peripheral surface of the platen are all arranged in body 10 such that they oppose opening 16. Also arranged in body 10 are push-type tractor 26 for feeding continuous paper 24 to and winding it around the peripheral surface of platen 18, and guide mechanism 28 for guiding paper 24 from the tractor to the platen. Paper 24 is inserted into the main body from insertion port 30 formed on the rear surface of body 10, is fed to platen 18 by tractor 26, is printed on by head 20, and discharged from the main body through opening 16.

Figure 2:
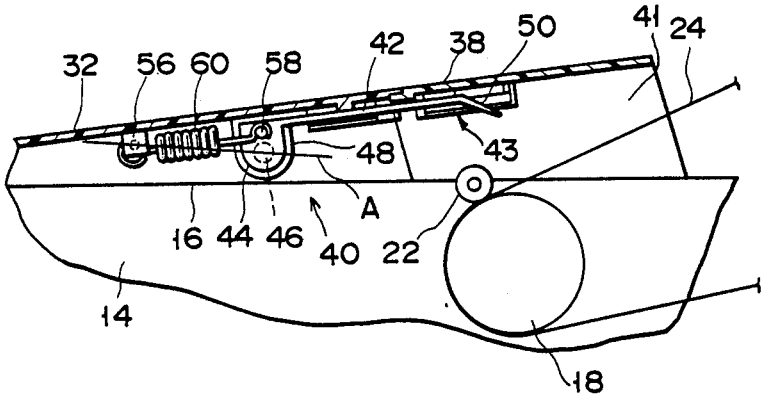
Figure 3:
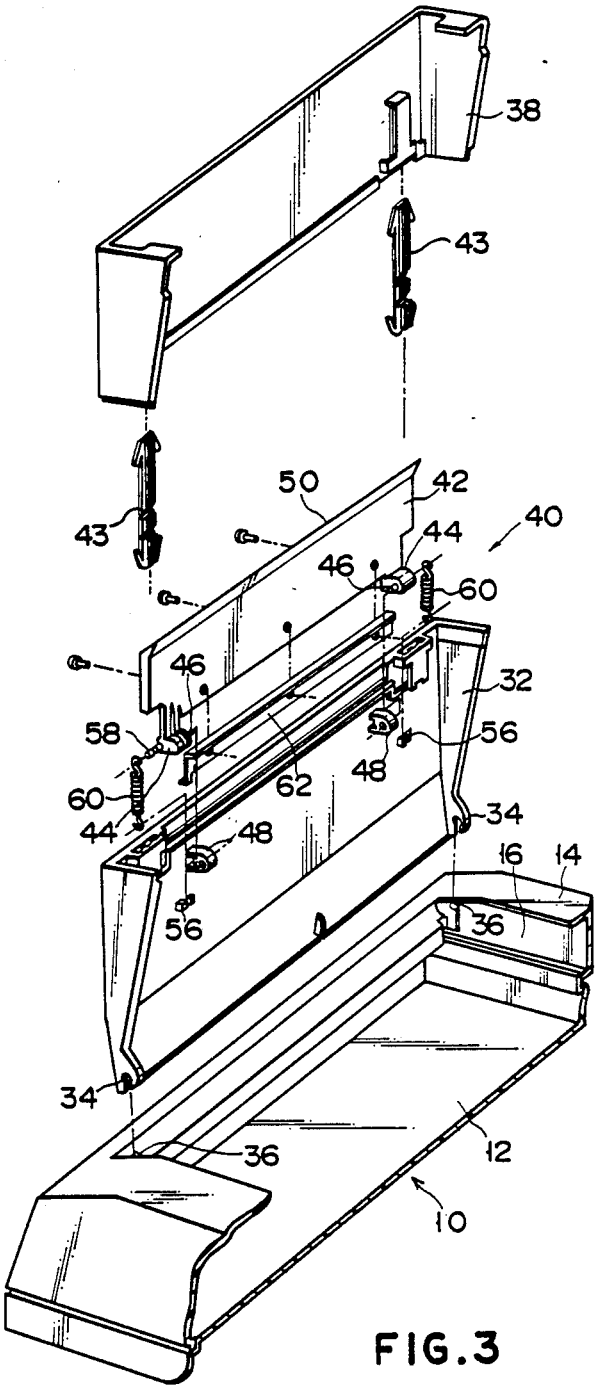

As is shown in FIGS. 1 to 3, case 14 is provided with front cover 32 for covering a front portion of opening 16. Cover 32 has hinges 34 at either end of the front edge thereof, hinges 34 being engaged with respective pivot pins 36 formed in case 14. Accordingly, cover 32 can pivot between a closing position (shown in FIG. 1) for covering the front portion of opening 16, and an opening position (shown in FIG. 3) for exposing opening 16, and can also be completely detached from case 14. As is shown in FIGS. 1 to 3, acoustic cover 38 is pivotally attached to front cover 32 by means of a pair of hinges 43 so as to cover a rear portion of opening 16. Thus, entire opening 16 is covered with covers 32 and 38 except for sheet discharge port 41.

Cutting mechanism 40 for cutting paper 24 is provided on an inner surface of cover 32. Mechanism 40 includes rectangular cutter 42 which has a length slightly larger than the width of paper 24. Support portions 44 are formed as proximal ends at both ends of one of long sides of cutter 44, and pivot pin 46 projects inwardly from each support portion 42 The other long side of cutter 42 forms blade 50. Each pin 46 is rotatably supported by each of a pair of support posts 48 formed on the inner surface of cover 32. Therefore, inside cover 32, cutter 42 can pivot about pins 46 through about 180°.

A pair of first holding portions 56 are formed adjacent to posts 48, respectively, on the inner surface of cover 32. Holding pin 58 as a second locking portion projects outward from each support portion 44 of cutter 42. Tension coil spring 60 is provided between each pin 58 and corresponding holding portion 56. Each pin 58 is eccentrically provided with respect to each pin 46. For example in the stand-by state of cutter 42 shown in FIG. 2, pin 58 is located at the side of cover 32 with respect to line A extending through pin 46 and the center of holding portion 56. For this reason, cutter 42 is biased counterclockwise about pins 46 and held in the stand-by position shown in FIG. 2. In the stand-by position, cutter 42 abuts against the inner surface of cover 32, and blade 50 thereof projects backward from the rear end of cover 32 and is located above platen 18. When paper 24 is to be cut, cutter 42 is pushed downward from the stand-by position to a cutting position (FIG. 5) where blade 50 abuts against the peripheral surface of platen 18 through paper 24. A size of cutter 42 is set so that an interval between blade 50 and a printing position of paper 24 by head 20 becomes a predetermined value (e.g., 11/12 inch or 13/12 inch) in the cutting position.

Note that in FIG. 3, reference numeral 62 denotes a cutter stay screwed to the proximal end portion side edge of cutter 42.

An operation of the printer having the above arrangement will be described below.

When paper 24 is to be printed, cover 32 is moved to the closing position, and cover 38 is also moved to a closing position for closing the rear portion of opening 16, as shown in FIGS. 1 and 2. Cutter 42 is moved to the stand-by position. In this state, paper 24 inserted in body 10 from port 30 is fed to platen 18 by tractor 26, printed by head 20, an then discharged from main body 10 through opening 16 and port 41.

Figure 4:
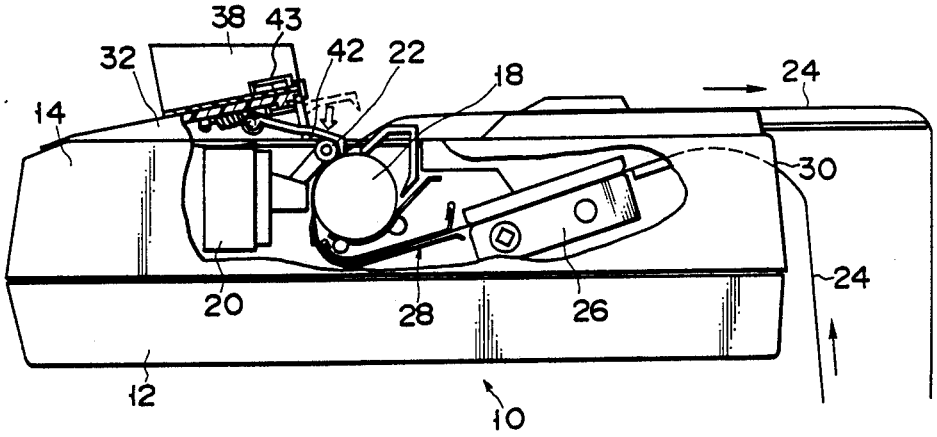
Figure 5:
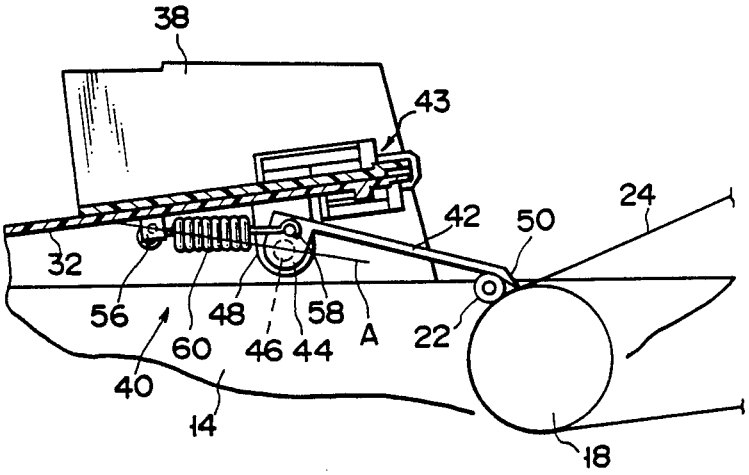

In order to cut paper 24 after printing, cover 38 is pivoted to an opening position so that the distal end portion, i.e., the blade portion of cutter 42 is exposed, as is shown in FIGS. 4 and 5. When an operator pushes down the blade portion of cutter 42 in a direction indicated by an arrow, cutter 42 is moved to a cutting position from the stand-by position. At the cutting position, blade 50 abuts against paper 24 wound around platen 18 at a position separated from a printing position by about 11/12 or 13/12 inch. In this state, a printed portion of paper 24, i.e., a portion discharged from body 10 is pulled up toward cutter 42 by the operator, and thus, paper 24 is cut along blade 50.

When the operator releases cutter 42 after cutting, cutter 42 is biased by spring 60 and returned to the stand-by position.

Figure 6:
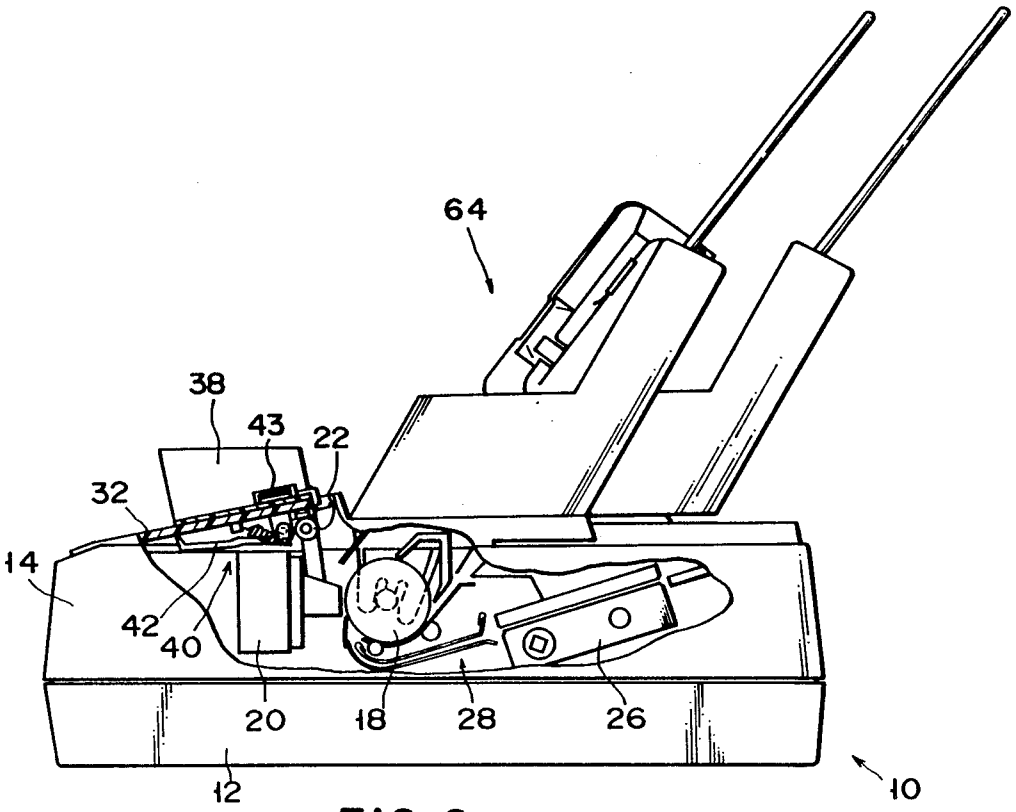
Figure 7:
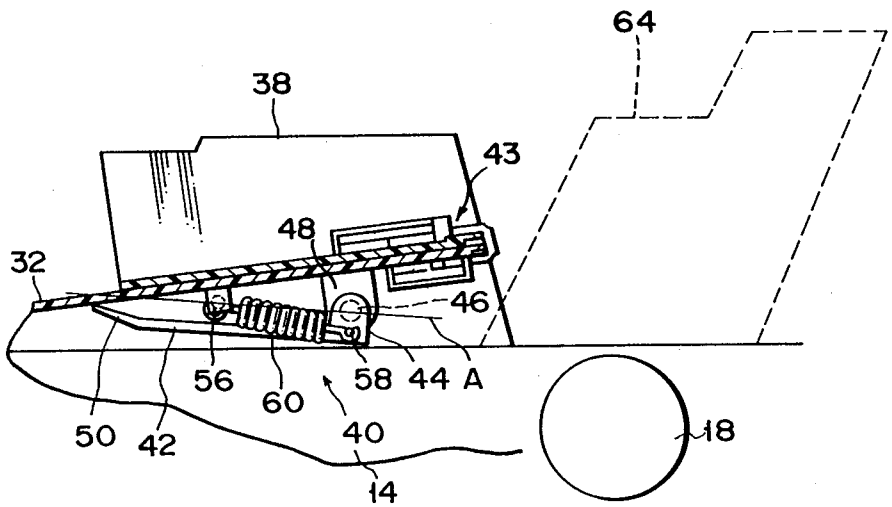

When a cut sheet is to be printed instead of continuous paper, cut sheet feeder 64 is mounted on case 14 of body 10, as shown in FIGS. 6 and 7. In this case, cover 38 is opened first, and cover 32 is pivoted to the opening position. Subsequently, by urging the blade portion of cutter 42, cutter 42 is pivoted clockwise about pins 46, i.e., in a direction away from cover 32. When pins 58 pass line A extending through the center of pin 46 and holding portion 56 by pivoting motion of cutter 42, cutter 42 is subjected to a clockwise pivoting force by springs 60. Therefore, after pins 58 pass line A, cutter 42 is automatically pivoted to the housing position (FIG. 7) where cutter 42 abuts against the inner surface of cover 32 to be housed therein, and is held therein. Subsequently, cover 32 is moved to the closing position while cover 38 is opened, and roller 22 is moved to a position separated from platen 18. In this state, since cutter 42 is held at the housing position, blade 50 of the cutter is not located above platen 18 and hence does not prevent mounting of feeder 64 on body 10. Therefore, feeder 64 can be mounted on body 10 while cover 32 is closed.

During printing, a cut sheet is fed to platen 18 by feeder 64, and after printing, returned to a housing portion of the feeder.

Note that when printing is not performed, the printer is set in the state shown in FIG. 1.

The printer of the above arrangement has the following advantages.

That is, according to the above printer, since cutter 42 is moved to the housing position to be housed in cover 32, feeder 64 can be mounted on the main body without detaching mechanism 40 together with cover 32 from body 10. For this reason, when the feeder is mounted, an operation of detaching the front cover from the main body can be omitted, and the detached front cover need not be kept. In addition, in a conventional printer, the front cover is detached when the feeder is mounted, and another front cover without a cutting mechanism is mounted on the main body. However, according to the printer of the present invention, two different front covers need not be prepared, thereby reducing manufacturing cost of the printer.

What is claimed is:

1. A printer comprising:

a main body having an upper opening;

a platen arranged in the main body so as to face the upper opening;

a printing head located in the main body so as to face the platen;

sheet feeding means, arranged in the main body, for supplying continuous paper around the platen;

a cover mounted on the main body to be rotatable between two positions, including a closing position for covering the opening except for a portion above the platen, and an opening position for exposing the opening; and a cutting mechanism for cutting continuous paper at a predetermined position, said cutting mechanism including: a cutter supported by the cover to oppose the main body, said cutter having a proximal end portion rotatably supported by the cover, and a blade extending from the proximal end portion, said cutter being rotatable between three positions, including a stand-by position where the blade is located above the platen, a cutting position where the blade abuts against the peripheral surface of the platen, and a housing position where the blade is rotated to a position adjacent a side of the cover opposing the platen at times when the cover is in the opening position; and biasing means for biasing the cutter toward the stand-by position when the cutter is located at a predetermined position adjacent the cutting position and for biasing the cutter toward the housing position when said cutter is located at a predetermined position adjacent the housing position.

2. A printer according to claim 1, wherein said cutting mechanism includes a first holding portion provided to the cover and located at a side opposite to the platen about the proximal end portion of the cutter, and a second holding portion formed to the cutter so as to be located at a side of the cover with respect to a line extending through the first holding portion and the proximal end portion of the cutter, when the cutter is located at the stand-by position, and said biasing means includes a tension coil spring provided between the first and second holding portions, for biasing the cutter toward the stand-by position when the second holding portion is located at a side of the cover with respect to the line, and for biasing the cutter toward the housing position when the second holding portion is located at a side of the main body with respect to the line.

3. A printer according to claim 2, wherein said cutter is formed to be a rectangle having a length corresponding to a width of the sheet, has support portions formed at both ends of one of long sides thereof, pivot pins provided at the support portions and rotatably supported by the cover to constitute said proximal end portion, and said blade is formed on the other long side of the cutter, and arranged so that the blade extends parallel to the platen.

4. A printer according to claim 3, wherein said second holding portion has holding pins formed on the support portions eccentrically with respect to the pivot pins.

5. A printer according to claim 1, wherein said cover is mounted on the main body to be detachable and pivotal between the closing and opening positions.

6. A printer according to claim 1, wherein said cover is formed so that the blade projects outward from the cover when the cutter is moved to the stand-by position.

7. A printer according to claim 6, which further comprises: a second cover, detachably mounted on the main body and located adjacent to the cover, for covering the upper opening and the blade of the cutter located at the stand-by position.

8. A printer according to claim 7, wherein said second cover is pivotally supported by the cover.

9. A printer according to claim 1, which further comprises: a cut sheet feeder, detachably mounted on the main body while said cutter is located at the housing position, for feeding a cut sheet to the platen.

10. A printer comprising:

a main body having an upper opening;

a platen arranged in the main body so as to oppose the upper opening;

a printing head located in the main body so as to face the platen;

sheet feeding means, arranged in the main body, for supplying continuous paper around the platen;

a cover mounted on the main body to be movable between two positions, including a closing position for covering the opening except for a portion above the platen, and an opening position for exposing the opening, and a cutting mechanism for cutting continuous paper at a predetermined position, said cutting mechanism including: a cutter supported by the cover to oppose the main body, said cutter having a proximal end portion rotatably supported by the cover, and a blade extending from the proximal end portion, said cutter being rotatable between three positions, including a stand-by position where the blade is located above the platen, a cutting position where the blade abuts against the peripheral surface of the platen, and a housing position where the blade is rotated to a position adjacent a side of the cover opposing the platen at times when the cover is in the opening position; and biasing means for biasing the cutter toward the stand-by position when the cutter is located at a predetermined position adjacent the cutting position, and for biasing the cutter toward the housing position when said cutter is located at a predetermined position adjacent the housing position;

wherein said cutting mechanism further includes a first holding portion provided to the cover and located at a side opposite to the platen about the proximal end portion of the cutter, and a second holding portion formed to the cutter so as to be located at a side of the cover with respect to a line extending through the first holding portion and the proximal end portion of the cutter, when the cutter is located at the stand-by position, and said biasing means includes a tension coil spring provided between the first and second holding portions, for biasing the cutter toward the stand-by position when the second holding portion is located at a side of the cover with respect to the line, and for biasing the cutter toward the housing position when the second holding portion is located at a side of the main body with respect to the line.

11. A printer according to claim 10, wherein said cutter is formed to be a rectangle having a length corresponding to a width of the sheet, has support portions formed at both ends of one of long sides thereof, pivot pins provided at the support portions and rotatably supported by the cover to constitute said proximal end portion, and said blade is formed on the other long side of the cutter, and arranged so that the blade extends parallel to the platen.

12. A printer according to claim 11, wherein said second holding portion has holding pins formed on the support portions eccentrically with respect to the pivot pins.

* * * * *